US006003255A

United States Patent [19]

Mahoney et al.

[11] Patent Number: 6,003,255

[45] Date of Patent: Dec. 21, 1999

[54] ADVERTISING SIGN AND DISPLAY

[76] Inventors: Paul Mahoney; Anita Kay Mahoney, both of 5539 E. Dahlia Dr., Scottsdale, Ariz. 85254

[21] Appl. No.: 09/132,207

[22] Filed: Aug. 11, 1998

[51] Int. Cl.[6] ..... G09F 15/00; G09F 7/02; G09F 7/22

[52] U.S. Cl. ..... 40/606; 40/611; 40/617

[58] Field of Search ..... 40/492, 606, 611, 40/617, 721, 723, 725, 734, 766, 767; 312/120, 270.2, 300, 321.5

[56] References Cited

U.S. PATENT DOCUMENTS

| | | | |
|---|---|---|---|
| 367,316 | 7/1887 | Pardee . | |
| 447,532 | 3/1891 | Bacon . | |
| 454,292 | 6/1891 | Rich . | |
| 490,687 | 1/1893 | Smith | 40/492 X |
| 1,062,601 | 5/1913 | Mittinger, Jr. . | |
| 1,127,223 | 2/1915 | Fogle . | |
| 1,128,249 | 2/1915 | Hickey . | |
| 1,364,209 | 1/1921 | Richardson . | |
| 1,422,529 | 7/1922 | Bingaman . | |
| 1,507,786 | 9/1924 | Monigan | 40/492 |
| 1,668,378 | 5/1928 | Pickett . | |
| 2,117,545 | 5/1938 | De Minico . | |
| 2,181,440 | 11/1939 | Terry . | |
| 2,299,409 | 10/1942 | Rathburn . | |
| 2,421,710 | 6/1947 | Mills . | |
| 3,008,788 | 11/1961 | Garner . | |
| 3,289,337 | 12/1966 | Golkowski . | |
| 4,322,905 | 4/1982 | Kruse . | |
| 4,691,456 | 9/1987 | Ackeret | 40/492 X |
| 4,815,612 | 3/1989 | Leo, Sr. | 40/606 X |
| 5,377,434 | 1/1995 | Wilson | 40/611 |

FOREIGN PATENT DOCUMENTS

| | | | |
|---|---|---|---|
| 2278224 | 11/1994 | United Kingdom | 40/611 |

*Primary Examiner*—Brian K. Green
*Attorney, Agent, or Firm*—LaValle D. Ptak

[57] ABSTRACT

An advertising display sign device particularly useful for real estate signs and similar displays. The device incorporates an inner frame in the general shape of a hollow rectangle, which is constructed with a length and height greater than its thickness. A narrow drawer is pivotally mounted near the bottom of the inner frame to tip outwardly through an opening in one of its minor sides; so that access may be made to the open top of the drawer. Because the pivot is on the forward edge of the drawer, the drawer returns to its closed position by gravity whenever it is released. Top, bottom and first and second end clamping members which fit together, are attached to the frame and extend a short space out from the opposing faces of the assembly. These clamping members hold in place first and second display panels, which are placed on both sides of the assembly to form an advertising surface. These first and second display panels cover the first and second major sides of the sign display device and also conceal the drawer when it is in its closed position.

20 Claims, 3 Drawing Sheets

FIG. 2
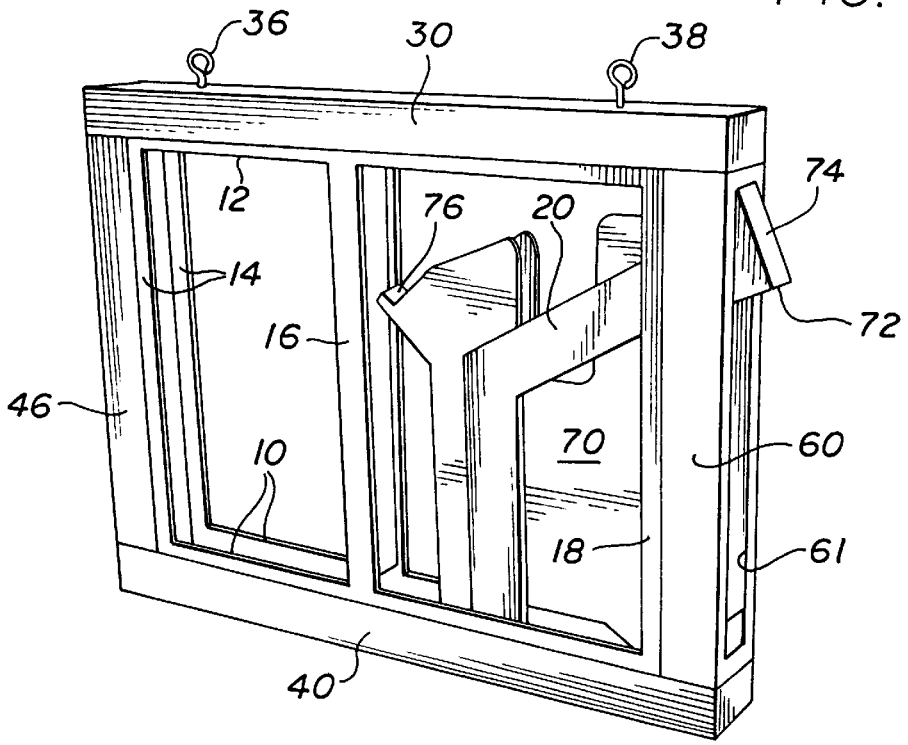
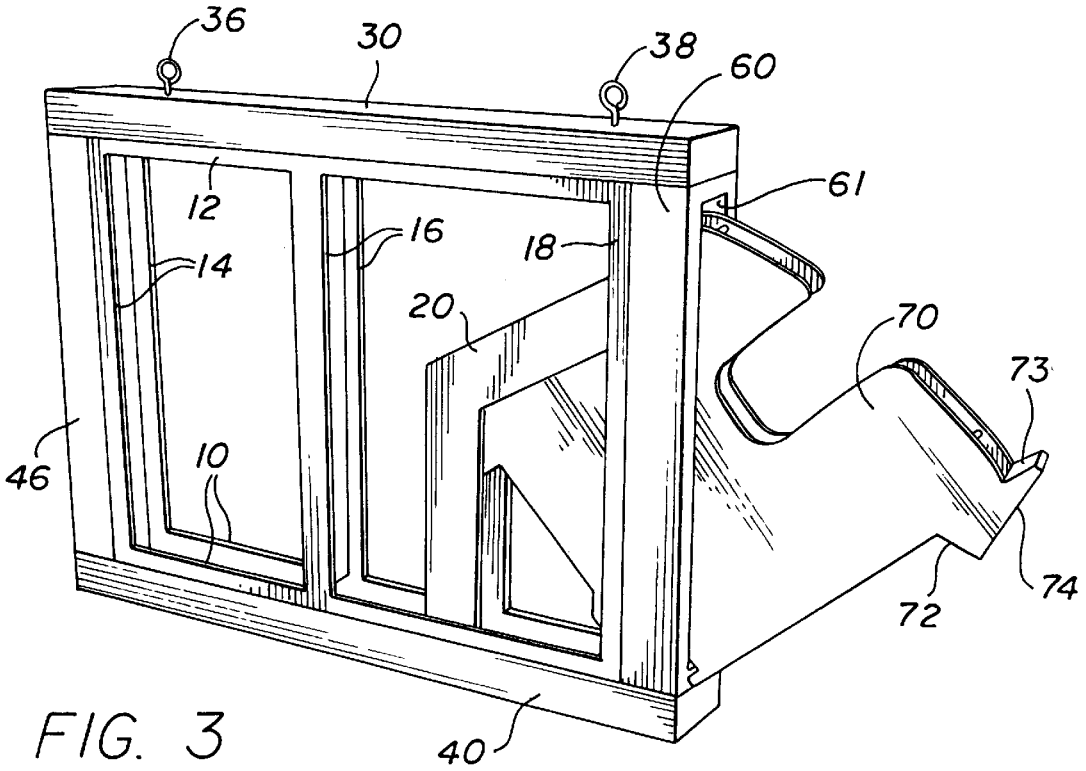
FIG. 3

62
60
66
64
74
73
72
70
24
78
18
38
28
34
76
71
20
22
44
30
12
16
40
32
26
10
36
52
14
42
48
46
50

ADVERTISING SIGN AND DISPLAY

BACKGROUND

Advertising signs and/or displays are used in a number of different businesses and frequently serve as point of sale devices. Typical signs include the well-known real estate signs, which are placed in front of homes being offered for sale. Typically, these signs include a vertical post with a horizontal arm extending outwardly from it, under which a sign, identifying the Realtor, is displayed. Usually, these signs include the telephone number of either the Realtor or of the seller of the home, without any further information. Some real estate signs include an additional hollow tube, open at one end and suspended beneath the sign, for holding information related to the property which is being sold. This information usually is in the form of a single sheet brochure; and a number of these brochures are rolled up together and placed in the tube, so that they may be withdrawn by prospective purchasers. Because the brochures are held in an open tube, they are subject to damage from rain or snow which may enter the tube from the open end.

A number of patents have been directed to combinations of advertising signs and dispensers for providing information to interested persons. For example, the United States patent to Kruse U.S. Pat. No. 4,322,905 is directed to a portable display sign, which includes an interior space designed to store display cards. The front and rear walls of the display sign have frames in them which are used for inserting removable display cards. The box-like structure of the sign has a space within it which is used to store additional display cards. The cards which are stored within the sign are not intended to be removed or handed out, but are intended as alternate displays for the exposed panels of the sign.

The United States patent to Golkowski U.S. Pat. No. 3,289,337 is directed to a real estate display sign. The sign is designed to hold replaceable display cards; and it is of a relatively thick walled construction, which has transparent walls on opposite sides. Replaceable display cards are placed between the transparent walls; and the device of this patent includes a second supplementary display area designed to permit rapid interchange of supplemental information cards.

The U.S. patent to Rathburn U.S. Pat. No. 2,299,409 is directed to a cabinet for a telephone book and for an advertising display. The cabinet has a pivotally mounted drawer which is used to contain information. The drawer pivots about its lower edge to expose a list of telephone numbers or other information located inside the cabinet and covered by the drawer when it is in its closed position.

U.S. Pat. No. 2,177,595 to DeMinico is directed to a card holder for placement on the window of an automobile. This holder includes a container for cards, which may be removed by a prospective purchaser. There is no separate sign and card holder; but the entire device is intended simply as a holder for displaying removable information.

The U.S. patent to Pickett U.S. Pat. No. 1,668,378 is a rectangular box-like sign. The device has replaceable display cards or panels on it, but does not include a separate drawer or container for removable brochures or cards.

The U.S. patent to Bingaman U.S. Pat. No. 1,422,529 is a combination sign and card holder. The sign section extends above a horizontally located card-holding box, which is open at its top. The sign provides desired information; and the card holder box contains cards which are available for removal by interested parties.

The U.S. Pat. No. 1,127,223 to Fogle discloses a cabinet with a display area for display cards. Cards not in current use may be stored inside the cabinet interior in a separate compartment.

The U.S. patent to Falk U.S. Pat. No. 1,061,601 is directed to a relatively complex mechanical advertising device. The device includes a flat surface with a paper roll located adjacent this surface. The paper roll extends over this surface and is directed to an area with instructions for the entry of the name and address of a person desiring to obtain information from the sign/display Operation of a lever causes the provided information to be stored and a mechanism is operated to dispense a display card to the person effecting the operation.

The patent to Rich U.S. Pat. No. 454,292 discloses a box-like advertising device which has vertical panels on it, into which advertising signs may be inserted and removed from the top. A number of drawers are located around the bottom of the cabinet: for receiving money or "paste-board" checks of the type formerly used in the barber industry at the time this patent was obtained.

While the foregoing patents disclose a number of different techniques used to display information and, in some cases, to serve as a repository or dispenser for cards to be taken by interested persons, none of these patents are particularly suitable for outdoor use or high traffic use where the structure for the sign itself also includes an interior drawer for holding removable information to be dispensed to persons desiring such information Accordingly, it is desirable to provide an improved advertising sign and display device, which is simple in construction, uncluttered in design, and easy to use to dispense information to interested persons, and which also overcomes the disadvantages of the prior art devices.

SUMMARY OF THE INVENTION

It is an object of this invention to provide an improved advertising sign display device.

It is another object of this invention to provide an improved advertising sign display device with replaceable advertising panels on it.

It is an additional object of this invention to provide an improved advertising sign display device with an internal, easily operated, information dispensing drawer in it.

It is a further object of this invention to provide a combined advertising sign and brochure dispensing device in which the advertising sign has replaceable sign panels on it; and the dispensing device is in the form of a pivoted drawer located between advertising panels for holding brochures or cards for subsequent removal by persons interested in the information displayed on the sign.

In accordance with a preferred embodiment of the invention, an advertising sign display device is comprised of a hollow internal frame member. This frame has first and second major sides or surfaces, and first and second minor sides, with a top and a bottom. The first minor side has an opening through it. A pivot is located in the hollow internal frame member between the first and second major sides, and adjacent the junction of the bottom of the frame member and the first minor side. A tilting or pivoting drawer then is attached to the pivot inside the frame member to move through the opening in the first minor side. First, second, third and fourth clamping members then are interconnected over the top, first and second minor sides and bottom, respectively, of the internal frame member; and they are secured to the hollow internal frame member. First and second panels, which may carry advertising information on them, cover the first and second major sides of the internal frame; and these panels are held in place by at least: some of the first, second, third and fourth clamping members.

BRIEF DESCRIPTION OF THE DRAWINGS

FIG. 2 is a partially exposed perspective view of a preferred embodiment of the invention in one mode of operation;

FIG. 3 is another perspective view similar to that of FIG. 2 showing the device in a second mode of operation.

DETAILED DESCRIPTION

Figure 1:
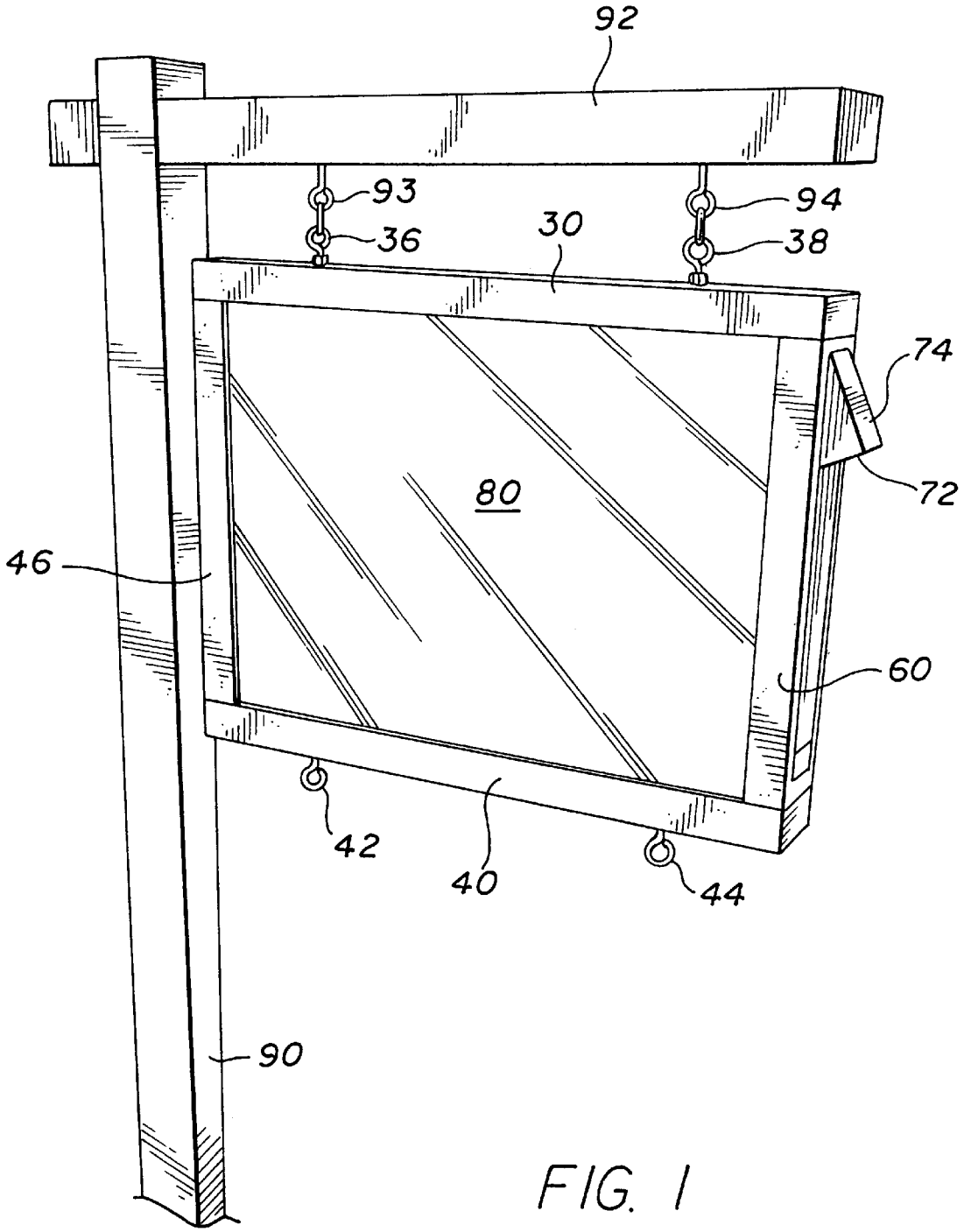
FIG. 1 is a perspective view of a preferred embodiment of the invention in a position of use.

Reference now should be made to the drawings, in which the same reference numbers are used throughout the different figures to designate the same or similar components. FIG. 1 is a perspective view of a preferred embodiment of the invention illustrating its manner of use as an advertising sign display mounted on a vertical post 90 with a horizontal cross arm 92 to suspend the sign. As illustrated in FIG. 1, the sign, consisting of upper and lower clamping members 40 and end clamping members 46 and 60, is suspended by a pair of eye bolts 36 and 38 fastened to the sign by means of hangers 93 and 94. The sign which is illustrated in FIG. 1 displays indicia on a pair of opposing panels 80 located on opposite major sides of the sign.

Figure 4:
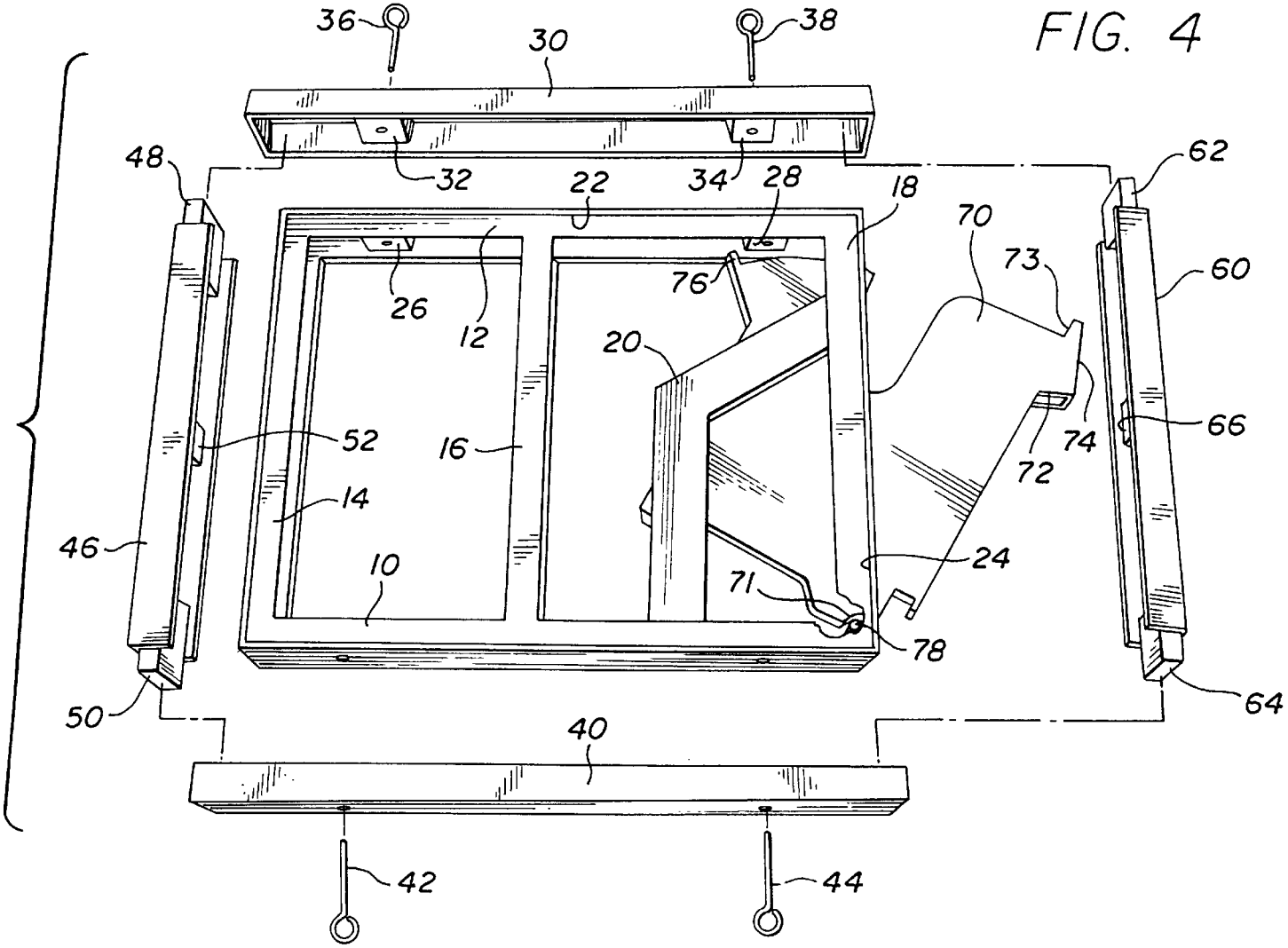
FIG. 4 is an exploded view illustrating details of a preferred embodiment of the invention.

The structure of the sign which is illustrated in perspective in FIG. 1 is shown in greater detail in FIGS. 2, 3 and 4. FIG. 4 is an exploded view of the sign structure; and reference should be made to that figure in conjunction with the illustrations of FIGS. 2 and 3. The display sign itself includes an inner frame consisting of a lower horizontal frame member 10, a parallel upper horizontal frame member 12, and vertical spacers 14, 16 and 18. The frame members 10, 12, 14 and 18 all essentially are in the form of U-shaped supports, with the legs of the U facing the inward part of the frame. The spacer members 16 are attached to opposite sides of the inwardly facing legs of the U-shaped members 10 and 12. This entire inner frame may be formed as a unitary molded plastic part; or it may be constructed of other suitable materials. The inner frame also may be made of various parts which assemble together to form the structure illustrated in FIGS. 2, 3 and 4.

The members 14 and 18 form the minor sides of the rectangular frame structure; and the member 18 has an elongated rectangular slot formed through it to accommodate passage of a pivoting drawer 70 through it, as illustrated most clearly in FIGS. 3 and 4,. To provide additional support for the internal frame in the area where the pivoting drawer 70 is located, a pair of generally triangular braces 20 are provided on the opposite sides of the frame; and these are attached to the inner facing legs of the U-shaped frame members 10 and 18, respectively.

It should be noted that in all of FIGS. 2, 3 and 4, the various components of the internal frame which are described are clearly shown for one major side, and comparable components for the opposite major side, corresponding to the ones which are visible, are located in a parallel plane a short distance from the side which is clearly visible. In the perspective views of FIGS. 2 and 3, some of these parallel components, such as the two central vertical support members 16, are clearly shown. This is also true of the inwardly facing legs of the bottom member 10 and the left-hand minor side member 14. It is to be understood, however, that for all of these members, the major sides are identical to one another.

The drawer 70 is pivotally supported on its bottom end by hinge pin 78, which either is integrally formed as a rib or ledge as a part of the structure of the internal frame between the upwardly facing legs of the U-shaped support member 10, or is a separate hinge pin 78, which is inserted in the position shown in FIG. 4 and secured in place. The drawer 70 has a pair of major identical sides located in parallel planes spaced a short distance from one another. At the bottom end of the drawer 70, on its forward edge, is a notch 71 which rests on the hinge pin 78, as shown most clearly in FIG. 4. This permits the drawer 70 to be pivoted from a stored position located inside the internal frame, as shown in FIG. 2, to a fully open position as shown in FIG. 3. FIG. 4 shows a partially open position of the drawer 70. The drawer 70 is inserted into the internal frame when it is in its open or exposed position, as shown in FIG. 4. The notch 71 is placed over the hinge pin 78; and once this is done, assembly of the remainder of the display sign structure may be effected.

The structure is held together by four clamping members, namely an upper clamping member 30, a lower clamping member 410, and first and second minor side clamping members 46 and 60.

As is readily apparent from an examination of FIG. 4, the upper and lower clamping members 30 and 40, respectively, are constructed in the form of elongated open rectangular boxes, with the box openings facing the respective upper and lower portions of the internal frame 10, 12, 14, 16, 18. The members 30 and 40 also are slightly longer than the length of the members 10 and 12. The elongated sides of the members 30 and 40 also extend over the sides of the frame members 12 and 10, respectively, when the clamping members are secured in place to the internal frame to form the structure shown in FIGS. 2 and 3.

The clamping members 46 and 60 for the minor sides of the internal frame member also have a structure which is generally similar to that of the members 30 and 40. The ends of the members 46 and 60, however, are open and have secured in them extending rectangular plugs 48 and 50 for the member 46, and 62 and 64 for the member 60, as shown most clearly in FIG. 4.

To assemble the device shown in FIGS. 2, 3 and 4, the bottom clamping member 40 first is secured in place by means of a pair of eye bolts 42 and 44, which are threaded through holes shown in FIG. 4, to secure the frame clamping member 40 in place over the bottom member 10 of the internal frame. Support blocks, not shown but similar to the blocks 26 and 28 shown in the upper frame member 12, are employed to provide threaded receptacles to secure the eye bolts 42 and 44 in place. Once the member 40 is secured to the internal frame, the plugs 50 and 64 are inserted in the manner shown in FIG. 4 to permit the side clamp members 46 and 60 to be located in the position shown in FIGS. 2 and 3. In this position, it should be noted that an elongated rectangular slot: 61, which is similar to the slot (not shown) in the vertical frame member 18, allows the drawer 70 to be pivoted from the position shown in FIG. 2 to the position shown in FIG. 3, through the slot 61. There are no connections which are necessary for the clamping members 46 and 60, other than the projection of the plugs 50 and 64 into the ends of the bottom clamping member 40. The plugs are held in place between the external surface of the vertical members 14 and 18 of the internal frame and the closed ends of the rectangular box-like clamping member 40.

When the clamping members 46 and 60 are positioned as illustrated in FIGS. 2 and 3, the top clamping member 30 then is moved downwardly into place to cause the plugs 48 and 62 to extend into the ends of the clamping member 30. Once everything is in the position shown in FIGS. 2 and 3, the eye bolts 36 and 313 are threaded through a pair of support blocks 32 and 34 in the clamping member 30, and into the threaded openings in a corresponding pair of support blocks 26 and 28 located on the inside of the upper horizontal member 12 of the internal frame. When the eye bolts 36 and 38 are threaded to securely hold the top clamp 30 in place, the entire assembly is firmly held together.

Typically, prior to the placement of the top clamping member 30 into the position shown in FIGS. 2 and 3, a pair of display panels 80 are inserted into the space which exists between a lip 22 formed all the way around the members 10, 12, 14 and 18, and the inside edge of the overlapping sides of the clamping members 30, 40, 46 and 60. The panels 80 are located on opposite sides of the internal frame to completely hide the structure of the internal frame and the drawer 70 from view, as illustrated in FIG. 1. The lip 22 ensures a proper space for the location of the panels; and the overlapping edges of the members 30, 40, 46 and 60 holds the panels 80 in place. After the panels 80 are put in place, the top clamp member 30 is secured as described above to form the completed structure shown in FIG. 2 (except that in FIG. 2 the panels 80 are not shown, in order to illustrate the relative location of the various parts of the device when it is operated). It also should be noted that strengthening support spacers, such as the spacers 52 and 66, are provided in the vertical clamping members 46 and 60 to ensure proper alignment and strength of the major surfaces of the clamping members 46 and 60 which overlie the edges of the major sides the internal frame.

As shown most clearly in FIGS. 2 and 4, the drawer 70 has projection 76 located near its upper rear edge. This projection 71 engages the upper edge of the rectangular opening 61 in the clamping member 60 when the drawer is moved to its fully opened position, as shown in FIG. 3. This prevents the drawer from tipping outwardly or falling out of the opening 61, and also delineates the maximum open position, as shown in FIG. 3.

Because the drawer 70 is hinged near its forward edge by means of the slot 71, the weight of the drawer and its contents are such that when the drawer is released, it does not remain in the position shown in FIG. 3, but automatically returns to the position shown in FIG. 2. If for some reason the weight of the drawer itself (including its contents) is not sufficient to perform this function, a suitable counterweight of some type may be attached to the lower rear (the left-hand bottom, as shown in FIGS. 2, 3 and 4) of the drawer 70 to ensure that it remains closed unless it is pulled or held open.

As is most apparent in FIGS. 2 and 4, the upper edge of the drawer, which projects from the rectangular slot 61, is in the form of a sloped surface 74 which has a hollow interior forming a pull handle 72 to facilitate rotating the drawer to the position shown in FIG. 3. The rear of this sloped portion includes a vertical surface 73, which abuts the outside of the clamping member 60 above the top of the slot 61 when the drawer 70 is in its closed position, further to serve as a stop for the drawer to locate it properly in the closed position shown in FIGS. 2 and 1.

When the device is used as a real estate sign, the panels 80 may carry any type of advertising indicia desired by the user. Typically, the panels 80 are in the form of rectangular laminated plastic panels designed to withstand the elements when the sign is located in an outdoor location, and mounted as illustrated in FIG. 1. For the material which is held in the drawer 70, letter-size brochures or other suitable materials may be placed vertically in the drawer; so that when the drawer is opened, the downward depending slit in the top of the drawer 70 permits the brochures easily to be grasped and removed from the drawer. Once a brochure has been removed, the drawer 70 returns by gravity to the position shown in FIGS. 1 and 2. The materials which are located in the drawer are safe from the elements, since they are protected by the top 12 of the internal frame and the clamping member 30 of the top of the assembly, as well as by the drawer itself, substantially enclosing the slot 61; so that rain and snow cannot enter the drawer which is fully contained within the rectangular sign housing, with none of the contents visible, as illustrated in FIG. 1.

Additional supplemental signs may be attached to the lower eye bolts 42 and 44 in a conventional manner; so that if additional information is desired, a separate sign can be used for this purpose. Although the advertising display sign which has been described above has been described in conjunction with its use as a real estate sign for an outside location, it is apparent that the sign can also be used at point-of-purchase displays or in inside advertising displays, if desired. The function of the sign is the same, whether it is located in an outside location or an inside location.

Preferably, the sign components comprising the internal frame, the drawer and the clamping members all are molded of high impact plastic. Although this is the preferred material, it is readily apparent that aluminum, wood or other materials may be used to construct the sign, which functions in every respect in the same way as it does when it is made from molded plastic. Consequently, the particular materials which are used are not considered important, so long as the materials have the structural integrity for the particular application which is to be made of the sign.

The foregoing description of the preferred embodiment of the invention is to be considered as illustrative and not as limiting. Various changes and modifications will occur to those skilled in the art for performing substantially the same function, in substantially the same way, to achieve substantially the same result without departing from the true scope of the invention as defined in the appended claims.

What is claimed is:

1. An advertising sign display device including in combination:

a hollow internal box-like frame member with first and second spaced apart major sides, first and second spaced apart minor sides, a top and a bottom, said first minor side having an opening therethrough;

a pivot in said hollow internal frame member between said first and second major sides and near a junction of said bottom with said first minor side;

a drawer attached to said pivot in said hollow internal frame member to pivotally move through the opening in said first minor side;

first, second, third and fourth clamping members interconnected over the top, first and second minor sides, and bottom, respectively, of said hollow internal frame member and secured to said hollow internal frame member; and first and second panel members substantially covering said first and second major sides of said internal frame member and held in place by at least some of said first, second, third and fourth clamping members.

2. The combination according to claim 1 wherein said hollow internal frame member is a rectangular box-like frame member.

3. The combination according to claim 2 wherein the opening in said first minor side is an elongated rectangular opening with a top and a bottom, and said pivot is located near the bottom of said elongated rectangular opening, with said drawer extending from the opening into said hollow internal frame member in a closed position of said drawer and pivoting through the opening on said pivot to an open position.

4. The combination according to claim 3 wherein said first, second, third and fourth clamping members extend over and are spaced from the first and second major sides of said hollow internal frame member to extend over said first and second panel members to hold said panel members in place on said first and second major sides of said hollow internal frame member.

5. The combination according to claim 4 wherein said first and second major sides of said hollow internal frame member are parallel and are spaced a first predetermine distance apart, and said first and second minor sides are spaced apart a second predetermined distance which is greater than said first predetermined distance.

6. The combination according to claim 5 further including fastening members to secure said first and fourth clamping members to said top and said bottom, respectively, of said hollow internal frame member, with said first and fourth clamping members extending over projections on said second and third clamping members to hold said second and third clamping members in place on said first and second minor sides, respectively, of said hollow internal frame member.

7. The combination according to claim 6 wherein said first and second panel members comprise removable panel members.

8. The combination according to claim 1 wherein said first, second, third and fourth clamping members extend over and are spaced from the first and second major sides of said hollow internal frame member to extend over said first and second panel members to hold said panel members in place on said first and second major sides of said hollow internal frame member.

9. The combination according to claim 8 further including fastening members to secure said first and fourth clamping members to said top and said bottom, respectively, of said hollow internal frame member, with said first and fourth clamping members extending over projections on said second and third clamping members to hold said second and third clamping members in place on said first and second minor sides, respectively, of said hollow internal frame member.

10. The combination according to claim 9 wherein said first and second major sides of said hollow internal frame member are parallel and are spaced a first predetermined distance apart, and said first and second minor sides are spaced apart a second predetermined distance which is greater than said first predetermined distance.

11. The combination according to claim 10 wherein said first and second panel members comprise removable panel members.

12. The combination according to claim 1 wherein the opening in said first minor side is an elongated rectangular opening with a top and a bottom, and said pivot is located near the bottom of said elongated rectangular opening, with said drawer extending from the opening into said hollow internal frame member in a closed position of said drawer and pivoting through the opening on said pivot to an open position.

13. The combination according to claim 12 wherein said first and second major sides of said hollow internal frame member are parallel and are spaced a first predetermined distance apart, and said first and second minor sides are spaced apart a second predetermined distance which is greater than said first predetermined distance.

14. The combination according to claim 1 further including fastening members to secure said first and fourth clamping members to said top and said bottom, respectively, of said hollow internal frame member, with said first and fourth clamping members extending over projections on said second and third clamping members to hold said second and third clamping members in place on said first and second minor sides, respectively, of said hollow internal frame member.

15. The combination according to claim 1 wherein said first and second panel members comprise removable panel members.

16. The combination according to claim 1 wherein said drawer has first and second major sides parallel to said first and second major sides of said hollow internal frame member, a bottom, and first and second ends with an open top wherein said first end is located in and substantially fills said opening in said first minor side of said hollow internal frame member with said drawer in its closed position.

17. The combination according to claim 16 wherein said drawer has a handle on said first end thereof to facilitate pivoting said drawer from its said closed position located within said hollow internal frame member to an open position with the top thereof extending outwardly from said first minor side of said hollow internal frame member to provide access to said drawer.

18. The combination according to claim 17 wherein said drawer and said hollow internal frame member have cooperating projections thereon to prevent said drawer from being pivoted outwardly through the opening in said first minor side of said hollow internal frame member more than a predetermined amount.

19. The combination according to claim 1 wherein said drawer has a handle on said first end thereof to facilitate pivoting said drawer from a first position located within said hollow internal frame member to a second position extending outwardly from said first minor side of said hollow internal frame member to provide access to said drawer.

20. The combination according to claim 1 wherein said drawer and said hollow internal frame member have cooperating projection thereon to prevent said drawer from being pivoted outwardly through the opening in said first minor side of said hollow internal frame member more than a predetermined amount.

* * * * *